United States Patent [19]

Grushkin et al.

[11] 4,032,339

[45] June 28, 1977

[54] PHOTOSENSITIVE COMPOSITION CONTAINING VANADYL PHTHALOCYANINE FOR PHOTOELECTROPHORETIC IMAGING SYSTEMS

[75] Inventors: Bernard Grushkin, Pittsford; Edward Forest, Rochester; Leonard M. Carreira, Penfield, all of N.Y.

[73] Assignee: Xerox Corporation, Stamford, Conn.

[22] Filed: May 24, 1976

[21] Appl. No.: 689,713

[52] U.S. Cl. ..... 96/1.5; 96/1 PE; 252/501

[51] Int. Cl.[2] ..... G03G 5/06

[58] Field of Search ..... 96/1 PE, 1.5; 252/501

[56] References Cited

UNITED STATES PATENTS

| | | | |
|---|---|---|---|
| 3,510,419 | 5/1970 | Carreira et al. | 96/1 PE |
| 3,825,422 | 7/1974 | Gruber et al. | 96/1 PE |
| 3,926,629 | 12/1975 | Weigl | 96/1 PE |
| 3,933,664 | 1/1976 | Nagashima et al. | 96/1 PE |

*Primary Examiner*—David Klein
*Assistant Examiner*—Judson R. Hightower
*Attorney, Agent, or Firm*—James J. Ralabate; Richard A. Tomlin; John H. Faro

[57] ABSTRACT

Photosensitive composition for use in photoelectrophoretic imaging system. The particulate component of this composition includes vanadyl phthalocyanine pigment particles which have been treated with a polymer having structural units of the formula

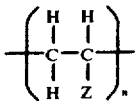

wherein Z is a pendant group of the formula

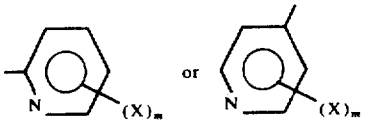

X is a substituent substantially incapable of withdrawing electrons from the electron rich pyridinyl moiety;

m is a whole number from 0 to 3; and n is a whole number in excess of 25.

The intimate association of at least some of the polymer with at least some of the vanadyl phthalocyanine pigment is believed to effectively attenuate photoinjection of holes from the phthalocyanine pigment into the surrounding materials thereby both reducing the $D_{min}$ of the phthalocyanine pigment; and, to improve color separation of reproductions prepared by processes employing a subtractive color system.

6 Claims, No Drawings

PHOTOSENSITIVE COMPOSITION CONTAINING VANADYL PHTHALOCYANINE FOR PHOTOELECTROPHORETIC IMAGING SYSTEMS

BACKGROUND OF THE INVENTION

1. Field of the Invention

This invention relates to improved photoconductive compositions useful in photoelectrophoretic imaging methods and apparatus. More specifically, this invention is directed to the treatment of vanadyl phthalocyanine pigment with a polymer which modifies its photoelectrophoretic response and renders it more compatible with other pigments commonly used in conjunction therewith in photoelectrophoretic imaging systems.

2. Description of the Prior Art

As is generally recognized in the art, a photoelectrophoretic imaging system is one wherein electrically photosensitive particles dispersed in a carrier liquid are initially subjected to an electric field and either simultaneously or thereafter exposed to activating electromagnetic radiation conforming to an image pattern. Photoelectrophoretic imaging techniques may be adapted for the preparation of both monochromatic and polychromatic reproductions. A detailed disclosure of both the monochromatic and polychromatic photoelectrophoretic imaging systems can be found in U.S. Pat. Nos. 3,383,933; 3,384,488; 3,384,565 and 3,384,566 (all of which are hereby incorporated by reference in their entirety). In one of the preferred embodiments of the photoelectrophoretic imaging method described in the above patents, a layer of an imaging suspension comprising electrically photosensitive pigment particles in an insulating carrier liquid is arranged between an injecting electrode and a blocking electrode (at least one of the electrodes being at least partially transparent); the photosensitive dispersion subjected to an applied electric field; and thereafter exposed to activating electromagnetic radiation conforming to an image pattern. Typically, complementary images are formed on the opposing surfaces of the electrodes which are in contact with the dispersion of pigment particles. In a monochromatic system, pigment particles of only one color are required; however, particles of more than one shade of the same color may be utilized where one desires to provide the capability to produce a range of monochromatic colors. In a polychromatic system, images of more than one color, and preferably full color, may be formed by utilizing a plurality of differently colored pigment particles which ideally have spectral response curves which do not substantially overlap each other, thereby providing the necessary color separation. In the preferred photoelectrophoretic imaging system referred to hereinabove, the pigment particles correspond to the subtractive colors yellow, cyan and magenta. The yellow pigment particles are primarily responsive to light within the blue region of the electromagnetic spectrum; the cyan particles are primarily photoresponsive to light within the red region of the electromagnetic spectrum; and the magenta particles are primarily responsive to light within the green region of the electromagnetic spectrum. Therefore, when a full color reproduction is projected upon a suspension containing these three pigments, the cyan particles will respond to that component of the image input corresponding to the color red, and upon being photoactivated will migrate from the electrode surface on which the image is to be formed thereby leaving behind the yellow and magenta pigment particles which together appear as red. Similarly, image input corresponding to green light will cause magenta particles to migrate and image input corresponding to blue light will cause the yellow particles to migrate. Where white light impinges upon the suspension containing the above three pigment particles, all such particles should migrate thereby leaving the surface of the image substantially devoid of pigment. The resulting image can thereafter be transferred to a receiving sheet, such as white paper, and thus the portions of the image which are deficient of pigment will appear as white in the finished copy. In order to obtain good color separation, it would be preferable that each pigment migrate only in response to activating electromagnetic radiation within its principal region of absorption.

Due to electrical interactions between the pigments and other unknown factors, photostimulated particle migration is often incomplete resulting in traces of the "subtracted" pigment remaining at the injecting electrode thereby imparting undesired color to the image found on this electrode.

As is discussed in the patents previously incorporated by reference, the pigment particles used in photoelectrophoretic imaging systems are initially charged and caused to migrate to the surface of one of two opposing electrodes in response to an electric field established between these electrodes. Upon absorption of light within its principal region of photoresponse, these pigments, it is theorized, generate hole-electron pairs and, depending upon the relative mobility of these charge carriers in the pigment, either one or both of these charge carriers are injected into the liquid carrier medium. Upon the injection of only one species of carrier into the medium, the particle will thereby acquire a net charge which preferably will be identical in sign to the polarity of charge of the electrode to which it had previously migrated. This similarity in charge will cause the pigment particle to be repelled by this formerly attractive electrode resulting in its migration to the surface of the opposing electrode where it forms a complementary image. It will be appreciated that if the above theoretical explanation is correct, the injection of both species of charge carrier into the liquid carrier medium will result in a failure of the photoactivated particle to migrate and thus in failure to generate the desired image. Moreover, in the event of indiscriminate injection of charge carriers from the photoactivated pigment into the liquid carrier medium and the subsequent transfer of such carriers to a non-photoactivated particle, the non-photoactivated pigment particle will migrate just as if it had absorbed the imaging energy. This migration of non-photo activated particles will seriously impair color separation in the desired reproduction.

It thus appears that in order for good color separation to be maintained and faithful reproduction of an original to be achieved, it is necessary to maintain selective electrophotographic response of the pigments to their colors of primary absorption. It is also apparent that this can only be achieved by preventing indiscriminate injection of charge carriers from photoactivated pigments into the liquid carrier medium.

The prior art contains frequent reference to various treatment of photoelectricphoretic pigments with diverse materials in order to modify or enhance the electrophotographic response of such pigments, for example: (a) the adsorption of donor and acceptor molecules on pigments utilized in photoelectrophoretic imaging, (b) the inclusion of such electrically active materials in the insulating liquid carrier containing such pigment particles, or (c) the application of these electrically active materials to one of the electrodes used in confining the pigment dispersion. All of the above treatments are said to result in charge transfer complex formation between the pigments and these electrically active materials, thereby facilitating injection of electrons from photoactivated pigment particles into the surrounding medium, U.S. application Ser. No. 566,846, filed July 21, 1966, now abandoned; published in Japan on Mar. 30, 1970, application Ser. No. 4636667, filed July 20, 1967.

Photoactive polymeric materials have also been disclosed as effective in modification of the electrophoretic response of pigment particles used in photoelectrophoretic imaging systems, U.S. application Ser. No. 863,507, filed Oct. 3, 1969, now abandoned, published in Holland on Apr. 6, 1971 as application Ser. No. 70.14614. Poly(N-vinylcarbazone) is disclosed in this Dutch patent as useful in the agglomeration and/or encapsulation of photomigratory pigment particles thereby enhancing the electrophotographic response of these particles to imaging energies.

Although the prior art systems described above enable substantial enhancement in the photoresponse characteristics of photomigratory pigment particles used in photoelectrophoretic imaging, further improvement is still required, especially with regard to the problems associated with color separation.

It is therefore the object of this invention to remedy the above, as well as related deficiencies in the prior art.

More specifically, it is the primary object of this invention to modulate the photoelectric response of certain photomigratory pigments so as to control the indiscriminate injection of charge carriers generated within such pigments from influencing the movement of nonphotoactivated pigments.

Another object of this invention is to provide a photosensitive composition having improved selective response to activating electromagnetic radiation.

Additional objects of this invention include the use of the above composition in photoelectrophoretic and photoimmobilization electrophoretic recording systems and methods.

SUMMARY OF THE INVENTION

The above and related objects of this invention are achieved by providing a photosensitive composition comprising an insulating carrier liquid, vanadyl phthalocyanine pigment and, based upon phthalocyanine pigment concentration, from about 0.1 to about 20 weight percent of a polymer comprising structural units of the formula

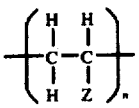

wherein Z is a pendant group of the formula

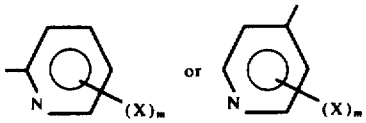

X is a substituent substantially incapable of withdrawing electrons from the electron rich pyridinyl moiety;

m is a whole number from 0 to 3; and n is a whole number in excess of 25.

The intimate association of vanadyl phthalocyanine pigment with the above polymer apparently influences the extent to which photogenerated charge carriers are injected into the medium within which such photosensitive pigment particles are routinely suspended. The precise nature of the physical and/or electrical influence exerted by the polymer upon the pigment particle is not known at this time. However, it is hypothesized that the intimate association of polymer with pigment has one or more of the following effects upon the pigment; namely, that it either facilitates the injection of electrons from a photoactivated pigment into the surrounding medium so as to increase the ratio of electrons to holes in the surrounding medium and/or precludes the injection of holes from a photoactivated pigment into the surrounding medium thereby also increasing the ratio of electrons to holes in the medium. Under certain conditions, the association of polymer with the photosensitive pigment can result in agglomeration of the pigment particles. Such agglomeration of the pigment is permissible provided the agglomerates do not exceed a particle size of in excess of about 25 microns.

DESCRIPTION OF THE INVENTION INCLUDING PREFERRED EMBODIMENTS

The photosensitive compositions of this invention can be prepared by dispersing vanadyl phthalocyanine pigment in a solvent within which the polymer has been previously dissolved, followed by ball-milling the resultant dispersion for an interval sufficient to promote intimate association of the polymer solution with the suspended pigment particles. The solvent can then be driven off, or preferably, an insulating carrier fluid, such as mineral oil, added to the dispersion and then the resulting dispersion heated in such a manner so as to facilitate the selective evaporation of the polymer solvent. The above procedure results in the intimate association of at least some of the polymer with at least some of the pigment particles. The sorption of the polymer on pigment particles may, but need not necessarily, result in the encapsulation of such particles by the polymer.

The photosensitive pigments of this photosensitive composition can comprise vanadyl phthalocyanine in any one of its stable forms. The vanadyl phthalocyanine of this composition can be prepared by any one of the techniques disclosed in the technical and patent literature; see for example, Moser and Thomas, Phthalocyanine Compounds, Chapter 3, ACS Monograph Series, Reinhold Publishing Corp., New York (1963). Once having prepared a vanadyl phthalocyanine pigment, the pigment is further refined by "acid pasting" in concentrated sulfuric acid or some other appropriate acidic medium. Acid pasting generally merely involves dissolving the unrefined vanadyl phthalocyanine pigment in the acidic medium and agitating the resulting solution. The temperature of the acid pasting medium is not allowed to rise to a level which could result in degradation of the pigment. Subsequent to this acid pasting procedure, the pigment is separated from the acidic solution by quenching in water. Materials not dissolved during the acid pasting procedure are separated from the acidic solution by filtration prior to quenching with water or pouring over ice. The terms "photosensitive," "photomigratory," "photoactive" and "photoelectrically active" are used interchangeably throughout this disclosure to describe the photoelectric properties of the above pigments of the composition of this invention.

The polymeric materials which are associated with the above pigment can comprise any one or combination of polymer segments having structural units of the formula set forth hereinabove. The vinyl pyridine monomers embraced by the above formula are generally commercially available, and where unavailable from commercial sources can be routinely prepared by methods disclosed in the literature from readily available materials. See, for example, *Vinyl and Diene Monomers*, Vol. XXIV, part 3, page 1376, Edited by E. C. Leonard, WileyInterscience Publication, N.Y.C. (1971). These monomers can by polymerized by standard free radical and anionic polymerization techniques. In the preferred embodiments of this invention, the polymeric material comprises poly(2-vinylpyridine). The method of association of the photomigratory pigment with the polymer will to some extent limit the type of polymers suitable for use in this interaction. For example, where the composition is prepared as described previously (solvent sorption of polymer on pigment), the polymer cannot, as a practical matter, be extensively cross-linked without adversely affecting its solubility and thus its ability to be associated with the pigment. The relative molecular weight of the polymers suitable for use in compositions of this invention does not otherwise appear to be critical. Polymers of 2-vinylpyridine having a number average molecular weight in the range of from about $10^3$ to $10^6$ are suitable for preparation of the compositions of this invention by the above procedures; with polymers of 2-vinylpyridine having a molecular weight in the range of 7000 to 10,000 being preferred. There is, however, an increasing tendency for polymers of 4-vinylpyridine to cross-link as their number average molecular weight exceeds 4000, and thus alternate methods of preparation of the photosensitive composition with this polymer are preferable to that described above. It is understood that any reference herein to the molecular weights of the polymers of this composition is based upon results obtained by gel permeation chromatography techniques using the Q values for polystyrene as a reference. The vinyl pyridine monomers and substituted vinyl pryidine monomers corresponding to the above formula can also be randomly copolymerized with a number of vinyl monomers and acrylate monomers. The structural units contributed to the copolymer by these vinyl and acrylate monomers must of course be electrically compatible with the contemplated environment of use of the resultant materials. That is, the structural units contributed to the resultant copolymers by these monomers must be substantially incapable of modification of the electronic interaction of the vinyl pyridine units and substituted vinyl pyridine units of the copolymer with the vanadyl phthalocyanine pigment. Vinyl monomers which satisfy the above requirements include styrene, alpha methyl sytrene, para methyl styrene and 4-isopropyl styrene. Acrylate monomers which satisfy the above requirements include n-butylmethacrylate, methyl methacrylate and ethyl methacrylate. Generally, any one or more of these materials can be copolymerized with the vinyl pyridine monomers and/or substituted vinyl pyridine described hereinabove in accord with standard free radical and anionic initiated polymerization techniques. If desired these same materials can be formed into block copolymers by standard anionic polymerizaton techniques. For example, one of the monomers of the block copolymer can be initially polymerized under conditions designed to produce an unterminated radical on the polymer segment formed from the first monomer. The second monomer can then be added to the charge, whereupon the radical of the previously polymerized material will serve to initiate polymerization of the newly added monomer and result in its propagation on the prepolymerized polymer segment.

Irrespective of which type of copolymer is formed from the above materials, the mole concentration of structural units contributed by the vinyl pyridine and/or substituted vinyl pyridine monomers relative to the structural units contributed by the other monomers should generally exceed about 20 and preferably 50 mole percent.

The effective relative concentration of polymer to pigment particle is a function of the relative efficiency with which such polymer is capable of sorption on the pigment and the desired modification of the photoelectric response of the pigment. Generally, the relative concentration of polymer to pigment in the composition will range from about 1 to about 20 weight percent. In a preferred embodiment of this invention, the polymer to pigment concentration is in the range of from about 5 to about 10 percent. It will be appreciated that certain polymers interact more efficiently with vanadyl phthalocyanine than do others and thus the preferred concentration of polymer to pigment may vary from one composition to another.

The photomigratory pigment composition prepared from the above materials can be dispersed in an insulating carrier liquid and the resulting dispersion will be suitable for use in both photoelectrophoretic and photoimmobilization electrophoretic recording systems and methods. This insulating carrier liquid dispersion medium preferably possesses a resistance of at least $10^7$ ohm-cm or greater. Materials which satisfy these requirements and which are chemically compatible with the photomigratory pigment compositions of this invention include saturated hydrocarbons such as decane, dodecane, N-tetradecane, molten paraffin, molten beeswax and other molten thermoplastic materials. Sohio Odorless Solvent (a kerosene fraction available from Standard Oil of Ohio), Isopar G (a long chain saturated aliphatic hydrocarbon available from Humble Oil Co. of New Jersey) and Klearol (a mineral oil product available from Witco Chemical Corp. of New York City) are generally preferred as insulating liquid carriers.

The vanadyl phthalocyanine/polymer particles obtained as described above may be dispersed in the insulating carrier liquid with at least one other pigment having its principal region of light absorption substantially outside the region of principal light absorption of the photomigratory pigment of the composition of this invention. In a preferred embodiment of this invention, the photoelectrically active pigment/polymer particles are dispersed in the insulating carrier liquid along with a photoelectrically active magenta colored pigment and a photoelectrically active yellow colored pigment.

In a typical photoelectrophoretic imaging system (PEP) the total pigment concentration in the insulating carrier liquid should preferably be in the range of from about 2 to about 10 weight percent. In the event that the photomigratory pigment dispersion is to be used in a photoimmobilization electrophoretic recording (PIER) process of the type described in West German Patent Publication DOS 2459-078, the useful range of pigment concentration can be as low as about 0.01 weight percent and can preferably range from about 0.1 up to about 1.5 weight percent.

The photomigratory pigments of the composition of this invention can have a particle size within the range of from about 0.1 to about 3 microns. The relative particle size of the pigments in the insulating carrier liquid need not be uniform and in fact a particle size distribution within the previously stated range may provide certain enhanced imaging capabilities. In a typical photoelectrophoretic or photoimmobilization electrophoretic recording system, the photomigratory pigment/insulating liquid carrier dispersion is passed through an imaging zone defined by two electrodes; one of which is nominally designated as the "injecting electrode" and the other being nominally designated as the "blocking electrode." In the context of this invention, the blocking electrode is regarded as an electrode which is substantially incapable of effecting charge exchange with the photomigratory pigments; whereas, the injecting electrode freely exchanges charge with the photomigratory pigments. In a photoimmobilization electrophoretic recording system, the injecting electrode will be typically coated with a dark injecting substance, such as a Lewis acid. The gap between the electrodes which defines the imaging zone can range from about 10 to about 250 microns. In order to achieve satisfactory image resolution and density with minimal background, the dielectric strength of the pigment dispersion at the imaging zone must be sufficient to support a field of at least 12 volts per micron; however, in order to achieve imaging capabilities of superior quality, the liquid dispersion should be preferably capable of supporting a field of about 40 volts per micron.

As indicated previously, the intimate association of polymer with vanadyl phthalocyanine can under certain conditions result in agglomeration of this pigment. In those compositions where the concentration of polymer necessary to achieve adequate attenuation of injection of photogenerated holes from the pigment into the surrounding medium results in excessive pigment agglomeration, it may be desirable to reduce the polymer concentration somewhat (by about 1 to 25%) and add small quantities (0.5 to about 5 mole percent based upon vanadyl phthalocyanine concentration) of electron acceptor compounds. Electron acceptor compounds which are effective in the attenuation of injection of holes from the photoactivated vanadyl phthalocyanine pigment include 2,4,7-trinitro-9-fluorenone and the malonitrile analogue thereof.

The Examples which follow further define, describe and illustrate the preparation and use of the vanadyl phthalocyanine/polymer particles of the compositions of this invention. Apparatus and techniques used in the preparation and evaluation of such materials are standard or as hereinbefore described. Parts and percentages appearing in such examples are by weight unless otherwise stipulated.

EXAMPLE I

Synthesis of Vanadyl Phthalocyanine

Into a 12 liter flask equipped with a magnetic stirrer and an air condenser are added 247 grams of phthalic anhydride, 247 grams of urea, 3 liters of chloronapthalene and 100 grams of vanadium trichloride. The mixture is heated to boiling under reflux conditions for approximately 45 minutes, cooled to 25° C and thereafter filtered. The solids which are recovered are washed with 300 mls of ethanol, then slurried in 100 mls of ethanol for two hours and subsequently filtered. The recovered pigment is thereafter subjected to a series of washes which are carried out at 70° C, each wash lasting approximately 2 hours: first wash, 2 liters of 10% sodium hydroxide solution; second wash, 2 liters of 20% hydrochloric acid; and third wash, 2 liters of deionized water. The pigment is recovered by filtration, the filter cake allowed to air dry for 24 hours and then dried in a vacuum oven at 65° C. The material produced in the manner which is described above is further refined by an acid pasting technique which is described as follows:

About 7.5 grams of unrefined vanadyl phthalocyanine is dissolved in 40 mls of concentrated sulfuric acid and stirred for about 50 minutes (the temperature of the system being carefully monitored so as to not permit the solution temperature to exceed 35° C). The solution is then poured through a coarse fritted funnel and sprayed into one liter of water which is maintained at a temperature in the range of from about 18° to 25° C. The spray injection of the filtrate is accomplished by means of two concentric glass tubes, so positioned as to create a vacuum at the orifice of the center tube when air is forced between the inner wall of the larger tube and outer wall of the smaller tube. Liquid passing through the smaller tube is atomized at the orifice by the passage of air between the two walls.

The crystals, which are recovered in the manner described above, are dispersed in water, filtered through a medium porosity filter, followed by five slurry water washes (750 ml each) at 70° C. The third and fourth washing solutions are modified in that they contain 18 mls of concentrated ammonium hydroxide. The filter cake which is ultimately recovered, subsequent to washing, is air dried and then dried in a vacuum oven at 65° C.

EXAMPLE II

Preparation of Poly(2-vinylpyridine) by free radical solution polymerization Commercially available 2-vinylpyridine (obtained from Reilly Tar and Chemical Co., Indiannapolis, Indiana) is initially purified by vacuum distillation at 5 Torr and 38° C. Azobisisobutyronitrile was selected as the free radical initiator for use in this synthesis (available from Eastman Kodak Co. of Rochester, New York).

Into a 3 neck 100 ml round bottom flask equipped with a mechanical stirrer, a sparging tube and a reflux condenser is poured 45 mls of benzene. The temperature of the flask and its contents are elevated to about 50° C and maintained at this level for approximately 2 hours while the benzene is sparged with argon. About 150 mgs (0.75 weight percent) of azobisisobutyronitrile are introduced into the flask followed by 20 grams of 2-vinylpyridine. The solution is maintained at 50° C for 12 hours under argon and then at 55° C for an additional 24 hours. The solution is cooled to 35° C and diluted with 150 mls tetrahydrofuran. The benzene(tetrehydrofuran/polymer solution is added dropwise to a mixture containing approximately 6 pints petroleum ether and 4 pints hexane. The solvent mixture is maintained in a constant state of agitation during the dropwise addition of the polymer solution. The addition of the polymer solution to this solvent quenches the polymerization and results in precipitation of the polymer. The polymer solids are recovered by filtration washed with petroleum ether and dried at 70° C in an air circulating oven overnight. Yield: 80% (16 grams) of cream colored polymer are obtained, Mn = 36K; Mw = 63.8K; MWD = 1.77. Number average molecular weight and weight average molecular weight analysis by gel permeation chromatography based upon a Q factor of 41.

EXAMPLE III

About 1 gram of the pigment as prepared in the manner described in Example 1 is dispersed in a benzene solution containing 10 weight percent, based upon pigment content, of (2-vinylpyridine). The dispersion is then transferred to a 60 ml jar containing 20 cubic centimeters of ⅛ inch stainless steel shot. The jar is sealed and its contents milled for 8 hours at 250 rpm. The dispersion is thereafter transferred to a 250 ml round bottom flask containing 30 mls of mineral oil (Klearol Witco Chemical Corporation, New York City). The jar and shot are washed with about 35 to 40 mls of benzene and the benzene wash also transferred to the 250 ml round bottom flask. The flask is set in a water bath at 70° C on a flash evaporator, the pressure reduced to 200 Torr thereby resulting in the evaporation of benzene from the flask. The pressure is then further reduced to between 60 and 100 Torr and maintained at this level for about 1 additional hour.

The above polymer treatment of the vanadyl phthalocyanine pigment can also be accomplished by initially milling the pigment in benzene and then subsequently treating the milled pigment with a benzene/polymer solution. The polymeric materials which do not become associated with the pigment can be removed by simply centrifuging the benzene dispersion. The heavier pigment particles will settle out and the benzene solution containing the free polymer can be simply siphoned off. It is thus possible using this technique to indirectly determine the amount of poly(2-vinylpyridine) which is associated with the pigment. Repeating the above treatment with up to 30 weight percent poly(2-vinylpyridine) indicates that satisfactory pigments are produced when the amount of polymer associated with the pigment is in the range of about 4 to 5 percent. Increasing the polymer in the benzene solution to in excess of 30 weight percent does not apparently increase the amount of polymer associated with the pigment.

The precise relationship between the pigment and the polymer is ill-defined. It is believed that some of the polymer is deposited on the surface of the pigment, however, the nature of this surface deposit does not result in encapsulation of the pigment particles.

EXAMPLE IV

The pigment/polymer dispersion, prepared in the manner described in the first paragraph of Example III, is combined with a dispersion of photoelectrically active magenta pigment and a dispersion of photoelectrically active yellow pigment. The pigment concentration of the resultant "trimix" (a three pigment electrophoretic ink) is approximately 15 percent. This trimix is then evaluated in a photoelectrophoretic imaging system of the type described in U.S. Pat. No. 3,384,488 (previously incorporated by reference in its entirety). Prior to introduction of a film of the dispersion into the gap between the injecting electrode and the blocking electrode, the pigment particles are charged so as to acquire a negative charge. Subsequent to their introduction into the gap between the opposing electrodes, a field is applied whereupon the negatively charged particles are attracted to and deposited upon the positively biased injecting electrode. The particles which are deposited upon the injecting electrode are then subjected to activating electromagnetic radiation conforming to a full color image whereupon some of these particles are selectively photoactivated and are thereby caused to migrate from the injecting electrode to the blocking electrode where they form a complementary image.

The above procedure is repeated except for the substitution of vanadyl phthalocyanine pigments which have not been subjected to polymer treatment for those pigments which have received such treatment. Comparison of the images produced utilizing the polymer treated pigments with the untreated pigments clearly demonstrates a reduction in $D_{min}$ of the cyan pigment and improved color separation with polymer treated vanadyl phthalocyanine pigments.

The above specific embodiments of this invention are merely intended to be illustrative and should not be interpreted as delineating the scope of this invention which is set forth in the following claims.

What is claimed is:

1. A composition comprising an insulating carrier liquid having dispersed therein from about 0.1 to about 10 weight percent photoelectrically active vanadyl phthalocyanine pigment and, based upon vanadyl phthalocyanine pigment concentration, about 1 to about 20 weight percent polymer comprising structural units of the formula

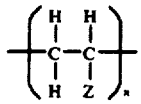

wherein Z is a pendant group of the formula

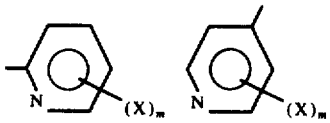

X is a substituent substantially incapable of withdrawing electrons from the electron rich pyridinyl moiety;

*m* is a whole number from 0 to 3; and

*n* is a whole number in excess of 25.

at least some of the polymer present in the composition being intimately associated with at least some of the phthalocyanine pigment present in the composition.

2. The composition of claim 1, wherein the pigment concentration ranges from about 0.1 up to about 0.5 weight percent.

3. The composition of claim 1, wherein the pigment concentration ranges from about 2 to about 10 weight percent.

4. The composition of claim 1 wherein the insulating liquid carrier has dispersed therein at least one other photoelectrically active pigment, said other pigment having a photoelectrophoretic response outside the range of principal photoelectrophoretic response of the vanadyl phthalocyanine/polymer pigment.

5. A composition comprising an insulating carrier liquid having dispersed therein from about 0.1 to about 10 weight percent photoelectrically active vanadyl phthalocyanine pigment and, based upon vanadyl phthalocyanine pigment concentration, about 1 to about 20 weight percent polymer comprising structural units of the formula

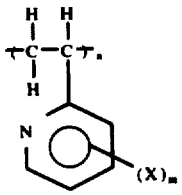

wherein

X is a substituent substantially capable of withdrawing electrons from the electron rich pyridinyl moiety;

*m* is a whole number from 0 to 3;

*n* is a whole number in excess of 25.

6. A composition comprising an insulating carrier liquid having dispersed therein from about 0.1 to about 10 weight percent photoelectrically active vanadyl phthalocyanine pigment and, based upon vanadyl phthalocyanine pigment concentration, about 1 to about 20 weight percent polymer comprising structural units of the formula

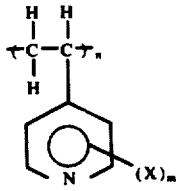

wherein

X is a substituent substantially capable of withdrawing electrons from the electron rich pyridinyl moiety;

*m* is a whole number from 0 to 3; and

*n* is a whole number in excess of 25.

* * * * *